US007780286B2

(12) United States Patent
Yahiro

(10) Patent No.: US 7,780,286 B2
(45) Date of Patent: Aug. 24, 2010

(54) IMAGE FORMING APPARATUS AND IMAGE FORMING METHOD

(75) Inventor: Yasuko Yahiro, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 708 days.

(21) Appl. No.: 11/730,129

(22) Filed: Mar. 29, 2007

(65) Prior Publication Data

US 2007/0229639 A1 Oct. 4, 2007

(30) Foreign Application Priority Data

Mar. 30, 2006 (JP) ..... 2006-095813

(51) Int. Cl.
*B41J 2/01* (2006.01)

(52) U.S. Cl. ..... 347/103

(58) Field of Classification Search ..... 347/101, 347/103

See application file for complete search history.

(56) References Cited

U.S. PATENT DOCUMENTS

| | | | | |
|---|---|---|---|---|
| 6,682,189 | B2 * | 1/2004 | May et al. | 347/103 |
| 2005/0110856 | A1 * | 5/2005 | Mouri et al. | 347/103 |
| 2006/0152566 | A1 | 7/2006 | Taniuchi et al. | |
| 2006/0164488 | A1 | 7/2006 | Taniuchi et al. | |

FOREIGN PATENT DOCUMENTS

| | | | |
|---|---|---|---|
| JP | 2002-370441 | A | 12/2002 |
| JP | 2004-114675 | A | 4/2004 |
| JP | 2005-14255 | A | 1/2005 |
| JP | 2005-14256 | A | 1/2005 |
| WO | WO-2004/022353 | A1 | 3/2004 |
| WO | WO-2004/113082 | A1 | 12/2004 |

* cited by examiner

*Primary Examiner*—Julian D Huffman
(74) *Attorney, Agent, or Firm*—Birch, Stewart, Kolasch & Birch, LLP

(57) ABSTRACT

An image forming apparatus forms an image on a recording medium by transferring an image formed on an intermediate transfer body to the recording medium. The image forming apparatus includes: a first liquid deposition device which performs deposition of a first liquid onto the intermediate transfer body, the first liquid containing solvent-insoluble material; a second liquid deposition device which performs deposition of a second liquid onto the intermediate transfer body before the deposition of the first liquid, the second liquid having a function of causing the solvent-insoluble material to aggregate; and a deposition control device which controls the deposition in such a manner that a minimum thickness of a layer of the second liquid formed on the intermediate transfer body at the deposition of the first liquid is not smaller than 1 μm, and a volume of the deposition of the second liquid per unit surface area is not smaller than a volume of the deposition of the first liquid per unit surface area.

9 Claims, 10 Drawing Sheets

TREATMENT LIQUID DEPOSITION VOLUME < INK DEPOSITION VOLUME

TREATMENT LIQUID DEPOSITION VOLUME ≧ INK DEPOSITION VOLUME

IMAGE FORMING APPARATUS AND IMAGE FORMING METHOD

BACKGROUND OF THE INVENTION

1. Field of the Invention

The present invention relates to an image forming apparatus and an image forming method, and more particularly to an intermediate transfer type image forming apparatus and method therefor, by which an image is formed on a recording medium by transferring an image formed on an intermediate transfer body to the recording medium.

2. Description of the Related Art

Inkjet recording apparatuses are known which use a so-called intermediate transfer system, in which an image is formed on an intermediate transfer body by a recording head (inkjet head), and the image formed on the intermediate transfer body is then transferred to a recording medium. In a recording apparatus in the related art, it is difficult to achieve high image quality as well as achieving good transfer characteristics on the intermediate transfer body. This is because intermediate transfer bodies that have good transfer and separation characteristics are often made from materials that basically have low surface energy and high liquid-repelling properties, and therefore liquid flows are liable to arise on the intermediate transfer body, and hence image quality is liable to decline. In view of these circumstances, various methods have been proposed in order to achieve good image quality on intermediate transfer bodies.

For example, Japanese Patent Application Publication Nos. 2005-14255 and 2005-14256 disclose methods for improving the surface of the intermediate transfer body. In Japanese Patent Application Publication No. 2005-14255, surface improvement is carried out by plasma processing or surfactant deposition processing on an intermediate transfer body having at least one surface made of a fluorocarbon compound or a silicone compound. In Japanese Patent Application Publication No. 2005-14256, surface improvement is carried out by applying energy to an intermediate transfer body with a surface having releasing properties.

Japanese Patent Application Publication No. 2002-370441 discloses a method which uses two types of liquid, namely a first liquid that contains a solvent-insoluble material, such as coloring material, and a second liquid that is reactive with respect to the first liquid and forms an aggregate. According to this method, when the second liquid is deposited onto an intermediate transfer body by a recording head and a first liquid is subsequently deposited onto the intermediate transfer body, an image free of bleeding and feathering is formed on the intermediate transfer body, and the image formed on the intermediate transfer body is then transferred to the recording medium, by supplying the second liquid at a smaller liquid deposition volume than the liquid deposition volume of the first liquid.

Japanese Patent Application Publication No. 2004-114675 discloses a method in which a first material that improves the wetting characteristics of an intermediate transfer body is deposited onto the intermediate transfer body, a second material for reducing the fluidity of the ink is deposited onto the intermediate transfer body, and ink is ejected from a recording head, thereby forming an image on the intermediate transfer body.

However, the methods disclosed in Japanese Patent Application Publication Nos. 2005-14255 and 2005-14256 are problematic in that they place a large load on the system. Moreover, although the method disclosed in Japanese Patent Application Publication No. 2002-370441 is valuable in achieving high image quality on an intermediate transfer body in a relatively low-speed system; in the case of a high-speed system, the time from the mixing of the first liquid and the second liquid on the intermediate transfer body until the transfer action is extremely short, and therefore, a sufficient reaction is not achieved, and it has been observed that the dots are disturbed during transfer and residual material is left on the intermediate transfer body after transfer. Consequently, there is a problem in that residual material on the intermediate transfer body must be removed and this places an extremely large burden on the cleaning of the intermediate transfer body surface. Furthermore, the method disclosed in Japanese Patent Application Publication No. 2004-114675 uses a process based on three materials, and system characteristics are poor.

SUMMARY OF THE INVENTION

The present invention has been contrived in view of the foregoing circumstances, an object thereof being to provide an image forming apparatus and an image forming method of an intermediate transfer type, which improves image quality on the intermediate transfer body, as well as making it possible to transfer an image formed on the intermediate transfer body, to a recording medium, satisfactorily and at high-speed.

In order to attain the aforementioned object, the present invention is directed to an image forming apparatus which forms an image on a recording medium by transferring an image formed on an intermediate transfer body to the recording medium, the apparatus comprising: a first liquid deposition device which performs deposition of a first liquid onto the intermediate transfer body, the first liquid containing solvent-insoluble material; a second liquid deposition device which performs deposition of a second liquid onto the intermediate transfer body before the deposition of the first liquid, the second liquid having a function of causing the solvent-insoluble material to aggregate; and a deposition control device which controls the deposition in such a manner that a minimum thickness of a layer of the second liquid formed on the intermediate transfer body at the deposition of the first liquid is not smaller than 1 μm, and a volume of the deposition of the second liquid per unit surface area is not smaller than a volume of the deposition of the first liquid per unit surface area.

According to this aspect of the present invention, a state is achieved where the first liquid becomes submerged inside the second liquid on the intermediate transfer body, and reaction is promoted in the whole of the first liquid, thereby making it possible to cause the solvent-insoluble material contained in the first liquid to aggregate immediately. Consequently, in addition to improving the image quality on the intermediate transfer body, it is also possible to achieve good transfer from the intermediate transfer body to the recording medium, even when using a high-speed system. Therefore, no residual material is left on the intermediate transfer body after the transfer and it is possible to reduce the cleaning load relating to the intermediate transfer body after the transfer.

In the present specification, "recording medium" does not only mean paper used in a general apparatus, but may also include cloth, metal, glass, ceramic, wood, plastic film, leather, or the like, In order to attain the aforementioned object, the present invention is also directed to an image forming apparatus which forms an image on a recording medium by transferring an image formed on an intermediate transfer body to the recording medium, the apparatus comprising: a first liquid deposition device which performs deposition of a first liquid onto the intermediate transfer body, the first liquid containing solvent-insoluble material; a second liquid deposition device which performs deposition of a second liquid onto the intermediate transfer body before the deposition of the first liquid, the second liquid having a function of causing the solvent-insoluble material to aggregate; and a deposition control device which controls the deposition in such a manner that a minimum thickness of a layer of the second liquid formed on the intermediate transfer body at the deposition of the first liquid is not smaller than 1 μm, and the second liquid is deposited not only onto a first liquid deposition region onto which the first liquid is to be deposited, but also onto a peripheral region surrounding the first liquid deposition region.

According to this aspect of the present invention, even if the second liquid dries on the intermediate transfer body and gives rise to a shrinking effect, the second liquid of a volume sufficient to react with the first liquid still remains. Consequently, in addition to improving the image quality on the intermediate transfer body, it is also possible to achieve good transfer from the intermediate transfer body to the recording medium, even when using a high-speed system. Therefore, no residual material is left on the intermediate transfer body after the transfer and it is possible to reduce the cleaning load relating to the intermediate transfer body after the transfer.

Preferably, the peripheral region extends from every side of the first liquid deposition region by at least a length corresponding to a diameter of a dot formed by the first liquid.

According to this aspect of the present invention, a good transfer rate can be achieved more readily, even in cases where the second liquid dries on the intermediate transfer body and gives rise to a shrinking effect.

Preferably, the maximum thickness of the layer of the second liquid is not greater than 9 μm.

According to this aspect of the present invention, it is possible to achieve a desired spreading rate of the first liquid and hence image quality is improved.

Preferably, a surface tension of the second liquid is not higher than a surface tension of the first liquid.

According to this aspect of the present invention, the second liquid not only has the function of causing the solvent-insoluble material in the first liquid to aggregate, but also has the function of improving the wetting properties of the first liquid. Therefore, the wetting properties of the first liquid reacting with the second liquid are improved, and hence a rate not less than 1.5 and not more than 4.0 can be achieved for the spreading rate of the first liquid, thus making it possible to improve image quality on the intermediate transfer body.

Preferably, the solvent-insoluble material includes a coloring material.

Preferably, the solvent-insoluble material includes at least one of a material which enhances fixing characteristics on the recording medium, a material which enhances wear resistance properties, and a material which enhances a transfer rate.

In order to attain the aforementioned object, the present invention is also directed to an image forming method for forming an image on a recording medium by transferring an image formed on an intermediate transfer body to the recording medium, the method comprising the steps of: depositing a first liquid onto the intermediate transfer body, the first liquid containing solvent-insoluble material; and depositing a second liquid onto the intermediate transfer body before the deposing step of the first liquid, the second liquid having a function of causing the solvent-insoluble material to aggregate, wherein a minimum thickness of a layer of the second liquid formed on the intermediate transfer body at the deposing step of the first liquid is not smaller than 1 μm, and a volume of the deposited second liquid per unit surface area is not smaller than a volume of the deposited first liquid per unit surface area.

In order to attain the aforementioned object, the present invention is also directed to an image forming method for forming an image on a recording medium by transferring an image formed on an intermediate transfer body to the recording medium, the method comprising the steps of: depositing a first liquid onto the intermediate transfer body, the first liquid containing solvent-insoluble material; and before the deposing step of the first liquid, depositing a second liquid not only onto a first liquid deposition region onto which the first liquid is to be deposited on the intermediate transfer body, but also onto a peripheral region surrounding the first liquid deposition region, the second liquid having a function of causing the solvent-insoluble material to aggregate, wherein a minimum thickness of a layer of the second liquid formed on the intermediate transfer body at the deposing step of the first liquid is not smaller than 1 μm.

According to the present invention, a state is achieved where the first liquid becomes submerged inside the second liquid on the intermediate transfer body, and reaction is promoted in the whole of the first liquid, thereby making it possible to cause the solvent-insoluble material contained in the first liquid to aggregate immediately. Consequently, in addition to improving the image quality on the intermediate transfer body, it is also possible to achieve good transfer from the intermediate transfer body to the recording medium, even when using a high-speed system. Therefore, no residual material is left on the intermediate transfer body after the transfer, and it is possible to reduce the cleaning load relating to the intermediate transfer body after the transfer.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

An inkjet recording apparatus according to an embodiment of the present invention is an inkjet recording apparatus of an intermediate transfer type, in which an image is formed on an intermediate transfer body by using an ink (first liquid) containing a solvent-insoluble material, such as coloring material, and a treatment liquid (second liquid) that is reactive with respect to the ink and has the function of causing aggregation of the solvent-insoluble material, and an image is formed on a recording medium by transferring the image formed on the intermediate transfer body to the recording medium.

Figure 1:
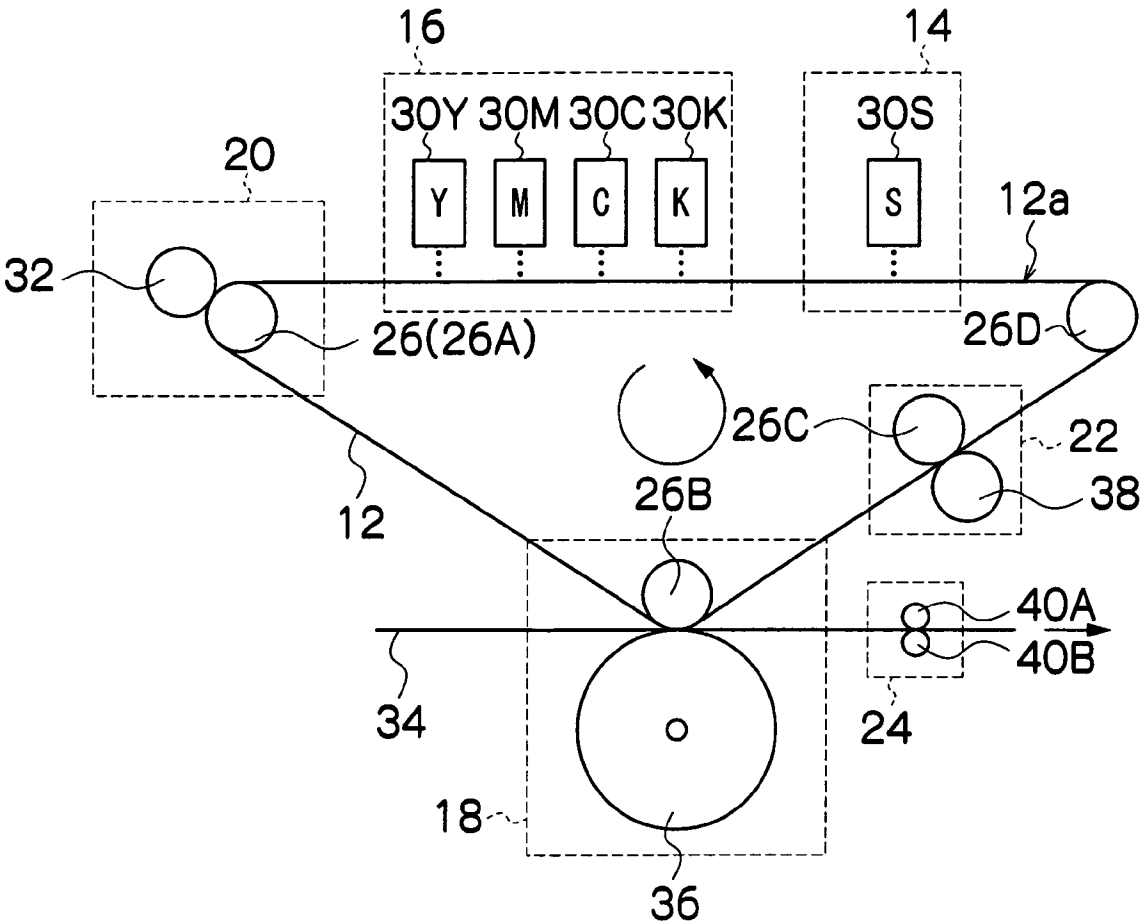
FIG. 1 is a general schematic drawing showing a general view of an inkjet recording apparatus according to an embodiment of the present invention.

FIG. 1 is a schematic drawing which shows the approximate composition of the inkjet recording apparatus according to the present embodiment. As shown in FIG. 1, the inkjet recording apparatus 10 according to the present embodiment includes: an intermediate transfer body 12, a treatment liquid supply unit 14, a marking unit 16 and a transfer unit 18; and also has a solvent removal unit 20, a cleaning unit 22 and an image fixing unit 24.

The intermediate transfer body 12 is constituted by an endless belt having a prescribed width, and it is wound about a plurality of rollers 26. In the present embodiment, for example, four rollers 26A to 26D are used. There are also modes which use a drum-shaped member and a plate-shaped member as the intermediate transfer body 12.

The driving force of a motor (not illustrated) is transmitted to at least one main roller of the plurality of rollers 26, and by driving this motor, the intermediate transfer body 12 is caused to rotate about the outer side of the rollers 26 (26A to 26D) in the counter-clockwise direction in FIG. 1 (hereinafter, called the "direction of rotation of the intermediate transfer body").

A recording head (treatment liquid head) 30S corresponding to the treatment liquid (S) is provided in the treatment liquid supply unit 14. The treatment liquid head 30S ejects treatment liquid from an ejection face which opposes the intermediate transfer body 12. Accordingly, the treatment liquid is deposited onto the recording surface 12*a* of the intermediate transfer body 12.

The marking unit 16 is disposed on the downstream side of the treatment liquid supply unit 14 in terms of the direction of rotation of the intermediate transfer body. The marking unit 16 includes recording heads (ink heads) 30K, 30C, 30M and 30Y corresponding respectively to the inks of the colors of black (K), cyan (C), magenta (M) and yellow (Y). The ink heads 30K, 30C, 30M and 30Y respectively eject inks of the corresponding colors, from ejection faces which oppose the intermediate transfer body 12. Accordingly, the inks of respective colors are deposited onto the recording surface 12*a* of the intermediate transfer body 12.

The treatment liquid head 30S and the ink heads 30K, 30C, 30M and 30Y are all full line heads formed with a plurality of ejection ports (nozzles) through the maximum recordable width of an image formed on the intermediate transfer body 12. This makes it possible to records images at higher speed onto the intermediate transfer body 12, compared to a serial head which records by moving a short shuttle head back and forth reciprocally in the breadthways direction of the intermediate transfer body 12 (the direction of the obverse-reverse of the sheet containing FIG. 1). Of course, the present invention can also be applied suitably to a serial head system that is capable of relatively high-speed recording, for example, a one-pass recording system which forms one line by means of one scan.

In the present embodiment, all of the recording heads (the treatment liquid head 30S, the ink heads 30K, 30C, 30M and 30Y) have the same structure, and below, a representative example of the recording heads is denoted with the reference numeral 30. The mechanism of the recording head 30 is described hereinafter. The implementation of the present invention is not limited to a case where the recording heads all have the same structure, and it is possible, for example, for the treatment liquid head 30S and the ink heads 30K, 30C, 30M and 30Y to have separate structures.

When the treatment liquid has been deposited from the treatment liquid head 30S onto the intermediate transfer body 12, then due to the rotation of the intermediate transfer body 12, the region of the intermediate transfer body 12 on which the treatment liquid has been deposited is moved successively to positions directly below the ink heads 30K, 30C, 30M and 30Y, and the corresponding inks of the respective colors are deposited from the ink heads 30K, 30C, 30M and 30Y As described above, the treatment liquid has a function of causing the solvent-insoluble material (coloring material, etc.) in the inks to aggregate. Therefore, the inks deposited on the intermediate transfer body 12 assume a high viscosity by reacting with the treatment liquid, thereby preventing landing interference between ink droplets of the same color or different colors, and hence forming an image of high quality on the intermediate transfer body 12.

The solvent removal unit 20 is disposed on the downstream side of the marking unit 16 in terms of the direction of rotation of the intermediate transfer body 12. The solvent removal unit 20 includes a solvent removal roller 32, which faces the roller 26A across the intermediate transfer body 12. The solvent removal roller 32 is constituted by a porous material in the shape of a roller, and it is disposed in such a manner that it abuts against the recording surface 12*a* of the intermediate transfer body 12. Other modes involve a method which removes excess solvent from the intermediate transfer body 12 by means of an air knife, or a method which removes the solvent by heating and evaporating it, or the like.

In the solvent removal unit 20, the solvent on the recording surface 12*a* of the intermediate transfer body 12 is removed by means of the solvent removal roller 32. Therefore, even if a large amount of the treatment liquid is deposited onto the recording surface 12*a* of the intermediate transfer body 12, the solvent is removed by the solvent removal unit 20 and consequently, there is no transfer of large quantities of solvent (dispersion medium) to the recording medium 34, in the transfer unit 18. Therefore, even in cases where paper is used as the recording medium 34, the characteristic problems of aqueous solvents, such as curling and cockling, do not occur.

The transfer unit 18 is disposed on the downstream side of the solvent removal unit 20 in terms of the rotation direction of the intermediate transfer body 12. The transfer unit 18 includes a pressurization roller 36 at a position facing the roller 26B across the intermediate transfer body 12. The recording medium 34 is conveyed from the left-hand side to the right-hand side in FIG. 1, in such a manner that it passes between the intermediate transfer body 12 and the pressurization roller 36. When the medium passes between the intermediate transfer body 12 and the pressurization roller 36, the front surface side of the recording medium 34 makes contact with the recording surface 12*a* of the intermediate transfer body 12, and pressure is applied by the pressurization roller 36, from the rear surface side of the recording medium 34, thereby causing the image formed on the recording surface 12*a* of the intermediate transfer body 12 to be transferred onto the recording medium 34. Here, it is preferable that the pressurization roller 36 and/or the roller 26B is heated, and the transfer characteristics are thereby improved.

The cleaning unit 22 is disposed on the downstream side of the transfer unit 18 in terms of the direction of rotation of the transfer body 12, and on the upstream side of the treatment liquid supply unit 14 in terms of the direction of rotation of the transfer body 12. The cleaning unit 22 includes a cleaning roller 38, which is provided in a position facing the roller 26C across the intermediate transfer body 12 and is disposed so as to abut against the recording surface 12*a* of the intermediate transfer body 12, thereby removing the residual matter, and the like, which is left on the recording surface 12*a* of the intermediate transfer body 12 after the transfer.

The cleaning roller 38 may be made of a flexible and porous member, which cleans the surface of the intermediate transfer body 12 (recording surface 12*a*) while being impregnated with cleaning liquid from a cleaning liquid deposition device, or a brush may be provided on the surface of the cleaning roller 38 and dirt may be removed from the surface of the intermediate transfer body 12 with the brush, while depositing cleaning liquid onto the surface of the intermediate transfer body 12. Alternatively, residual material on the surface of the intermediate transfer body 12 may be wiped away by providing a flexible blade on the surface of the cleaning roller 38. Making the linear speed of the surface of the cleaning roller 38 slower or faster than the linear speed of the surface of the intermediate transfer body 12, rather than the same speed, enables the removal rate of the residual matter to be increased. This is because the speed differential between the surface of the cleaning roller 38 and the surface of the intermediate transfer body 12 generates a shearing force at the surface of the intermediate transfer body 12, and this causes the residual matter to be removed effectively.

The image fixing unit 24 is disposed on the recording medium output side of the transfer unit 18 (the right-hand side in FIG. 1). The image fixing unit 24 includes two fixing rollers 40A and 40B, arranged at the front and rear surfaces of the recording medium 34, and by heating and pressurizing the image having been transferred to the recording medium 34 by means of these fixing rollers 40A and 40B, it is possible to increase the fixing characteristics of the recording image on the recording medium 34.

Next, the structure of the recording head 30 is described.

Figure 2:
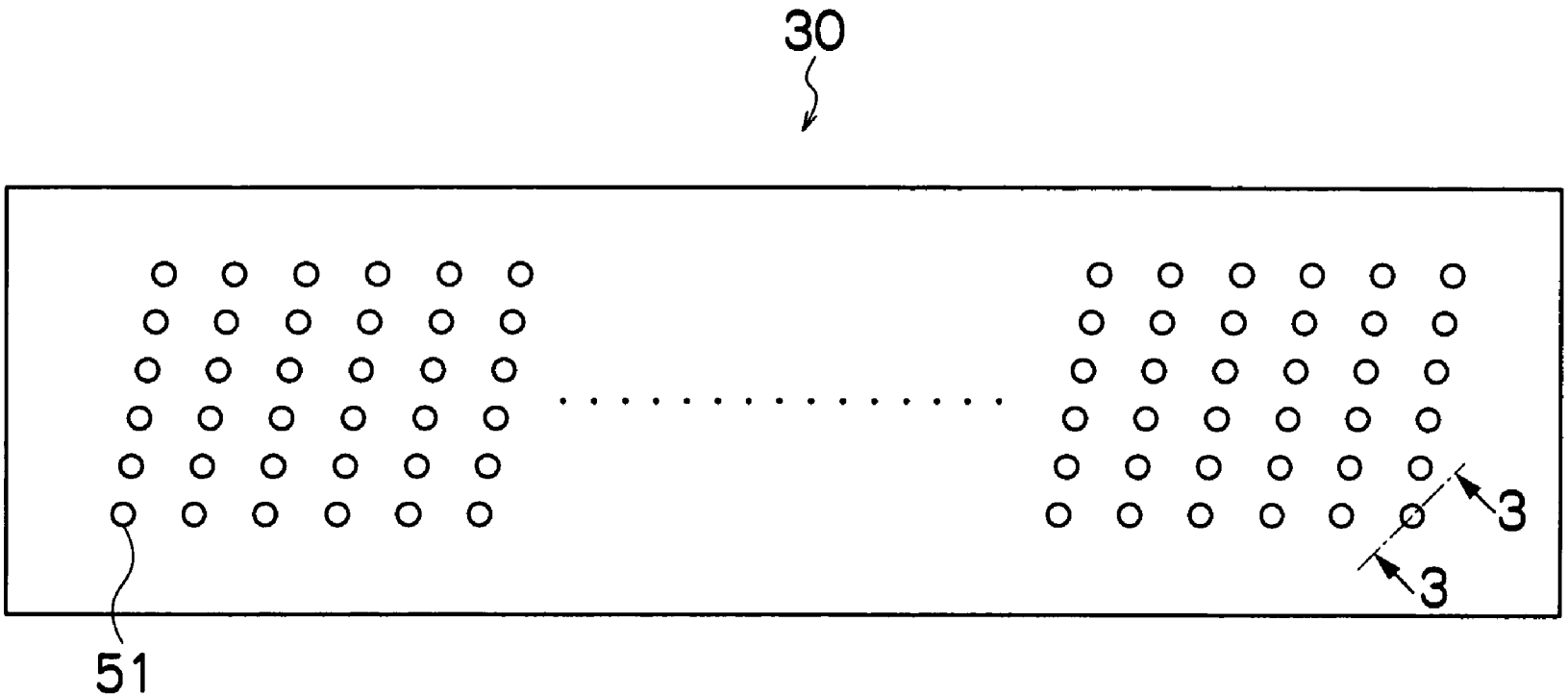
FIG. 2 is a plan diagram showing an ejection surface of a recording head in the inkjet recording apparatus.
Figure 3:
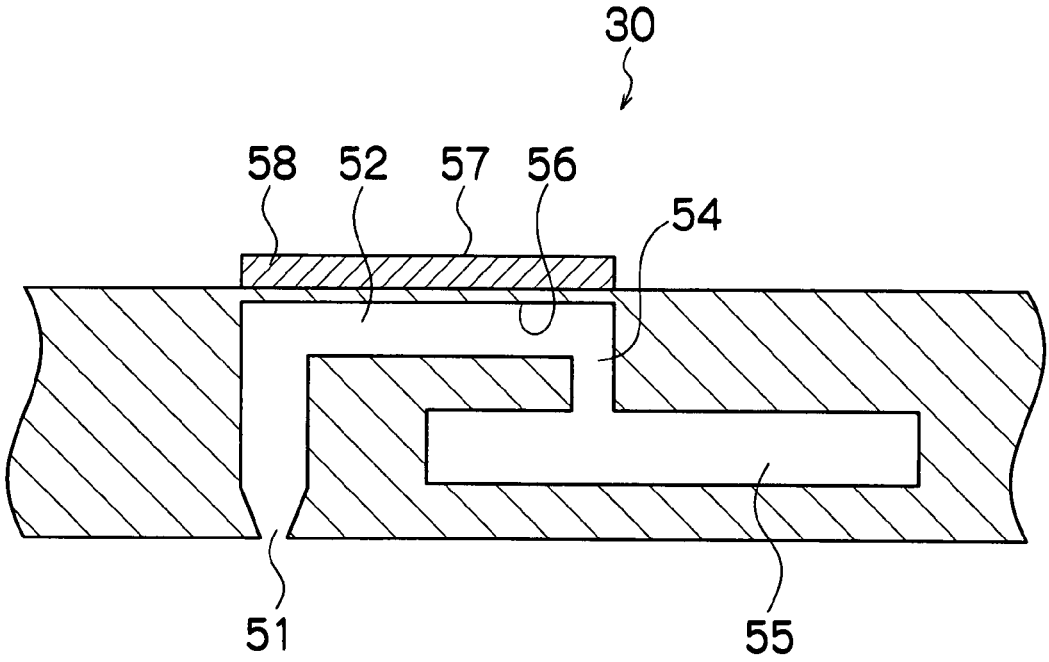
FIG. 3 is a partial cross-sectional diagram along line 3-3 in FIG. 2.

FIG. 2 is a plan diagram showing the ejection surface of the recording head 30, and FIG. 3 is a partial cross-sectional diagram along line 3-3 in FIG. 2. In FIG. 2, the lengthwise direction of the head 30 corresponds to the direction of the obverse-reverse of the sheet containing FIG. 1. The recording head 30 according to the present embodiment is constituted by a full line head formed with a plurality of ejection ports (nozzles) 51 through a length corresponding to the maximum recording width of an image formed on the intermediate transfer body 12. As shown in FIG. 2, the nozzles 51 are arranged two-dimensionally (in a matrix configuration) following the lengthwise direction of the head and an oblique direction which is not perpendicular to the lengthwise direction of the head, and it is possible to achieve high-resolution image recording on the intermediate transfer body 12 by means of this high-density arrangement of the nozzles.

As shown in FIG. 3, pressure chambers 52 connected to the nozzles 51 are provided in the recording head 30, for the respective nozzles 51. A supply port 54 is formed at one end of each pressure chamber 52, and the pressure chamber 52 is connected to a common flow channel 55 by means of this supply port 54. A prescribed liquid (treatment liquid or ink of one of the respective colors) is accumulated in the common flow channel 55, and the liquid is supplied from the common flow channel 55 to the pressure chambers 52.

One wall of each pressure chamber 52 (the upper face in FIG. 3) is constituted by a diaphragm 56, and a piezoelectric element 58 is mounted on the diaphragm 56 at a position corresponding to the pressure chamber 52. An individual electrode 57 is provided on the upper surface of the piezoelectric element 58. In the present embodiment, the diaphragm 56 is constituted by a conductive material, and it also serves as a common electrode for the piezoelectric elements 58.

By adopting this composition, when a drive voltage is applied to the piezoelectric element 58, a pressure is applied to the liquid in the pressure chamber 52 due to the displacement of the piezoelectric element 58, thereby causing a droplet of the liquid to be ejected from the nozzle 51. After ejection, the liquid is supplied to the pressure chamber 52 from the common flow channel 55.

The present embodiment is a mode using a piezoelectric system, in which ejection is performed by using the piezoelectric elements 58, but the implementation of the present invention is not limited to this, and it is also possible, for example, to adopt a thermal system which performs ejection by using electrical-thermal converting elements, such as heaters, or other types of ejection systems.

Figure 4:
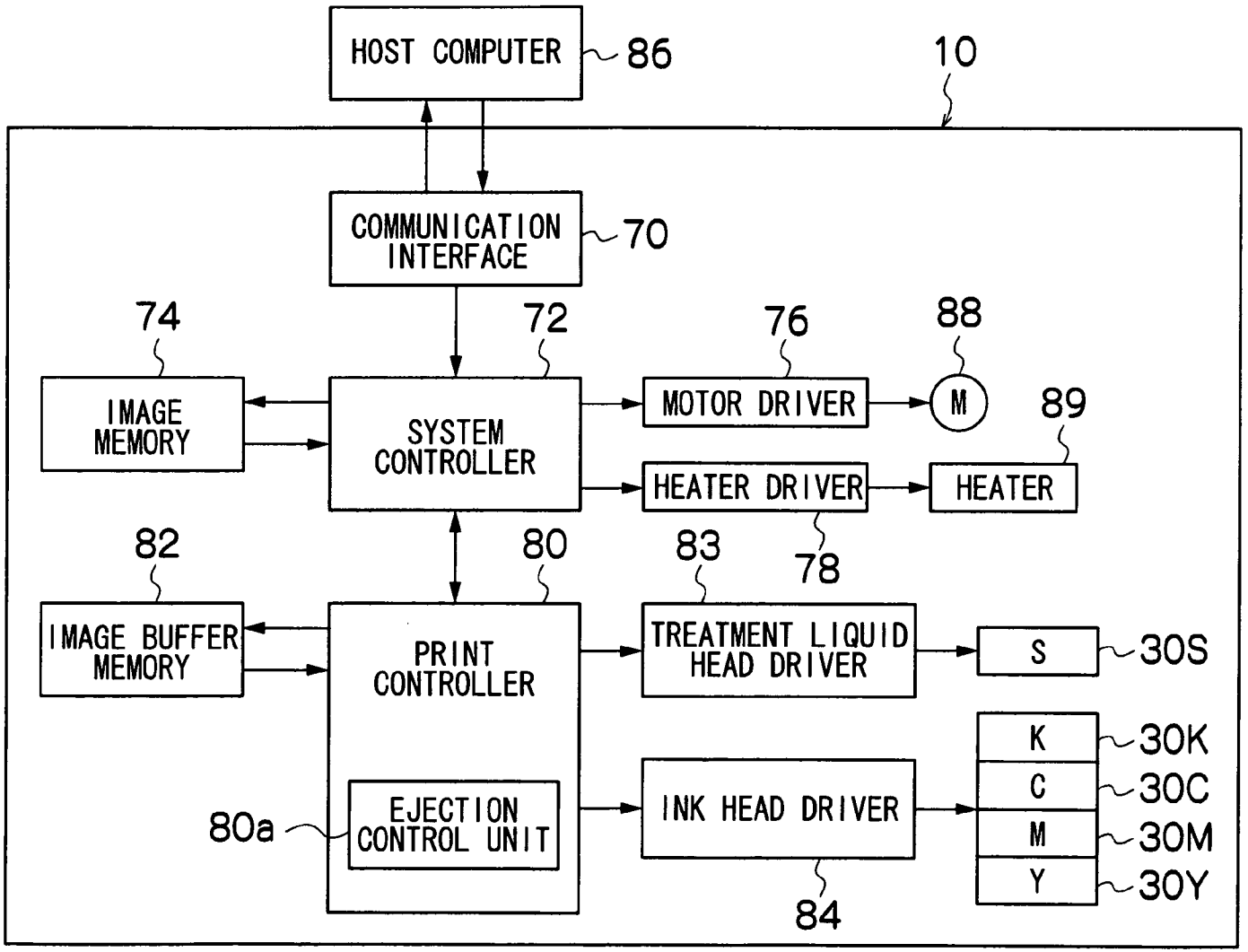
FIG. 4 is a principal block diagram showing the system composition of the inkjet recording apparatus.

FIG. 4 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a treatment liquid head driver 83, an ink head driver 84, and the like.

The communication interface 70 is an interface unit for receiving image data sent from a host computer 86. A serial interface or a parallel interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motors 88 of the various units and the heater 89.

The motor driver (drive circuit) 76 drives the motor 88 in accordance with commands from the system controller 72. The heater driver 78 drives the heater 89 in accordance with commands from the system controller 72.

The print controller 80 is a control unit having a signal processing function for performing various treatment processes, corrections, and the like, in accordance with the control implemented by the system controller 72, in order to generate a signal for controlling printing from the image data in the image memory 74. The print controller 80 supplies the print control signal (dot data) thus generated to the head drivers 83 and 84. Prescribed signal processing is carried out in the print controller 80, and the ejection volume and the ejection timing of liquid droplets from the recording heads 30 (30S, 30K, 30M, 30C, 30Y) are controlled via the head drivers 83 and 84, on the basis of the image data. By this means, prescribed dot sizes and dot positions can be achieved. The ejection control that is characteristic of the present invention is implemented by the ejection control unit 80*a* of the print controller 80.

The print controller 80 is provided with the image buffer memory 82; and image data, parameters, and other data are temporarily stored in the image buffer memory 82 when image data is processed in the print controller 80. The aspect shown in FIG. 4 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head drivers 83 and 84 (the treatment liquid head driver 83 and the ink head driver 84) respectively generate drive signals for driving the piezoelectric elements 58 (see FIG. 3) of the corresponding recording heads 30 (30S, 30K, 30C, 30M, 30Y), on the basis of the dot data supplied from the print controller 80, and they supply the generated drive signals to the piezoelectric elements 58, accordingly. A feedback control system for maintaining constant drive conditions for the recording heads 30 may be included in the head drivers 83 and 84.

Next, the ejection control, which is one of the characteristic features of the present invention, is described in detail.

The inkjet recording apparatus 10 according to the present embodiment is a high-speed system which enables high-speed recording at 80 ppm (page per minute) or above, using the intermediate transfer type of recording apparatus, which, as described previously, forms an image on the intermediate transfer body 12 by means of liquids of two types (treatment liquid and ink) and then transfers the image formed on the intermediate transfer body 12 to the recording medium 34, thereby forming an image on the recording medium 34. In the present embodiment, in order to prevent transfer defects in a high-speed system of this kind, ejection control is implemented in such a manner that either one of the following two conditions (a first ejection control condition and a second ejection control condition) is satisfied.

Firstly, the first ejection control condition is described. The first ejection control condition is the condition that the minimum thickness of the treatment liquid (layer) (formed on the intermediate transfer body 12) when an ink droplet lands on the intermediate transfer body 12 must be not smaller than 1 μm, and the treatment liquid deposition volume per unit surface area must be not smaller than the ink deposition volume per unit surface area. Here, the "minimum thickness of the treatment liquid" indicates the thickness of the thinnest portion of the layer of the treatment liquid formed on the intermediate transfer body 12, and the "maximum thickness of the treatment liquid" indicates the thickness of the thickest portion of the layer of the treatment liquid formed on the intermediate transfer body 12.

Figure 5A:
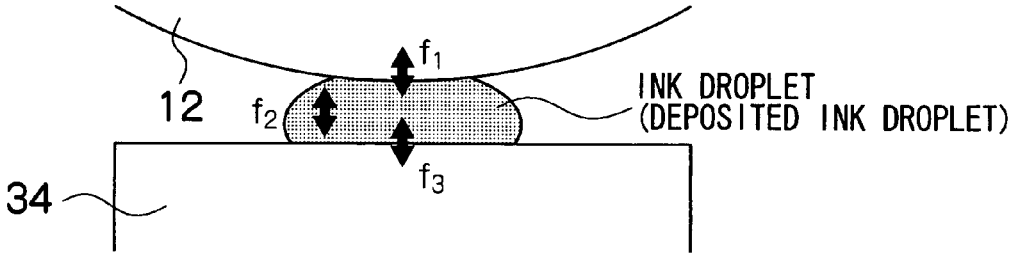
FIGS. 5A and 5B are diagrams for explaining the conditions required in order to achieve good transfer.
Figure 5B:
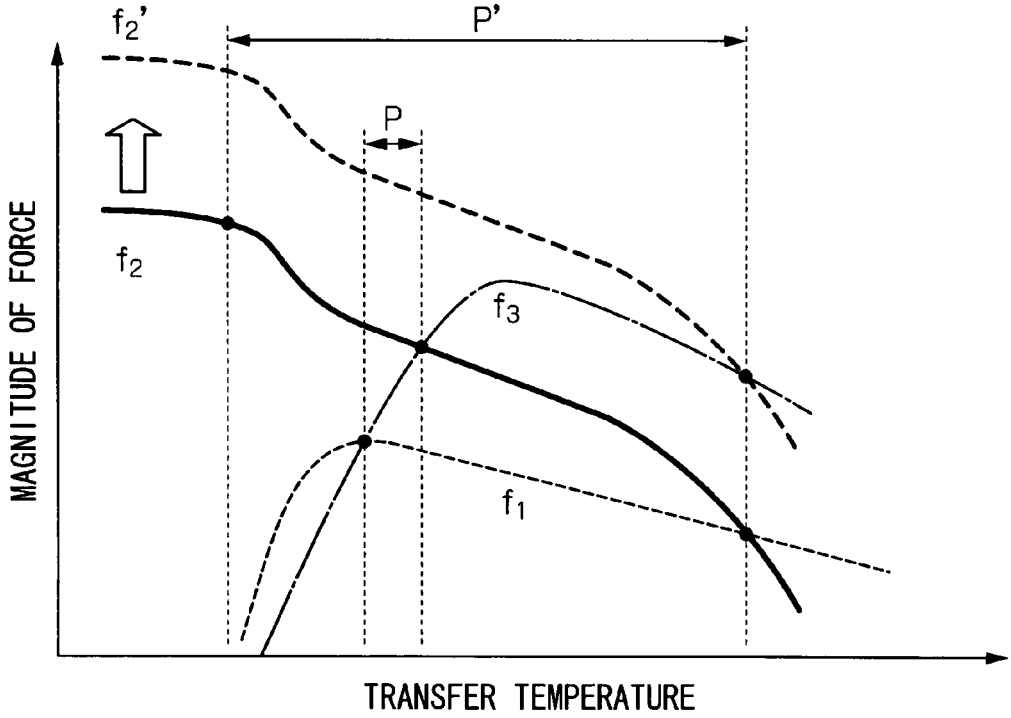

FIGS. 5A and 5B are diagrams for explaining the conditions required in order to achieve good transfer. FIG. 5A is a partial enlarged diagram of the transfer unit 18, showing a state where an ink droplet that has landed on the intermediate transfer body 12 (deposited ink dot) is being transferred to the recording medium 34. With respect to the adhesive force $f_1$ between the intermediate transfer body 12 and the deposited ink dot, the aggregating force $f_2$ within the deposited ink dot, and the adhesive force $f_3$ between the recording medium 34 and the deposited ink dot, in order to transfer the deposited ink dots successfully from the intermediate transfer body 12 to the recording medium 34, it is an essential condition that the relationship $f_2>f_3>f_1$ should be satisfied. FIG. 5B is a graph showing one example of the relationship between the forces $f_1$, $f_2$ and $f_3$ with temperature, and the favorable transfer temperature range is the range indicated by P. In this relationship, if the aggregating force within the deposited ink dot can be increased from $f_2$ to $f_2'$ ($>f_2$), then the satisfactory transfer temperature range can be expanded to P' (>P), and the transfer rate can be improved.

From the foregoing, in order to improve the transfer rate, it is necessary to increase the aggregating force within the ink droplet that have landed on the intermediate transfer body 12 (the deposited ink droplet), and in order to achieve this, it is necessary to deposit the treatment liquid onto the intermediate transfer body 12 before the ink, as in the present embodiment. A desirable method for depositing the treatment liquid is one which creates a state where the ink droplets become submerged inside the treatment liquid having been deposited on the intermediate transfer body 12.

Figure 6A:
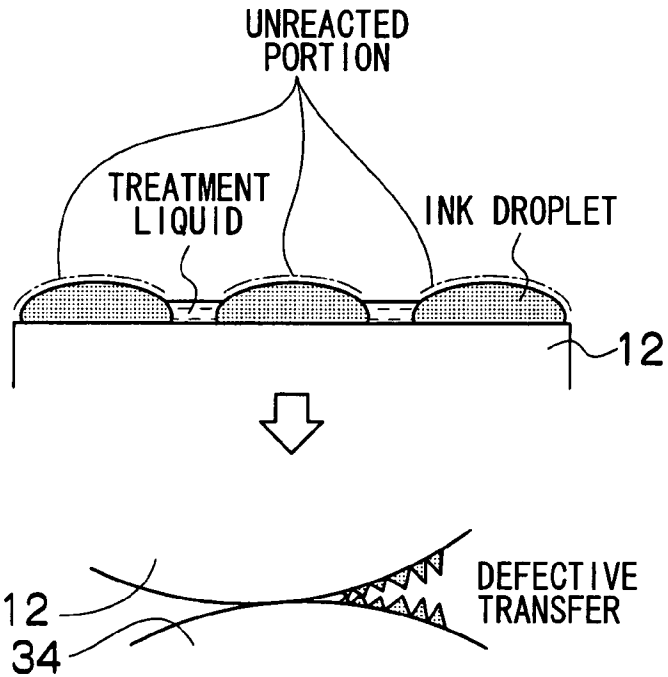
FIGS. 6A and 6B are diagrams showing the relationship between the deposition volumes of treatment liquid and ink, and the transfer rate.
Figure 6B:
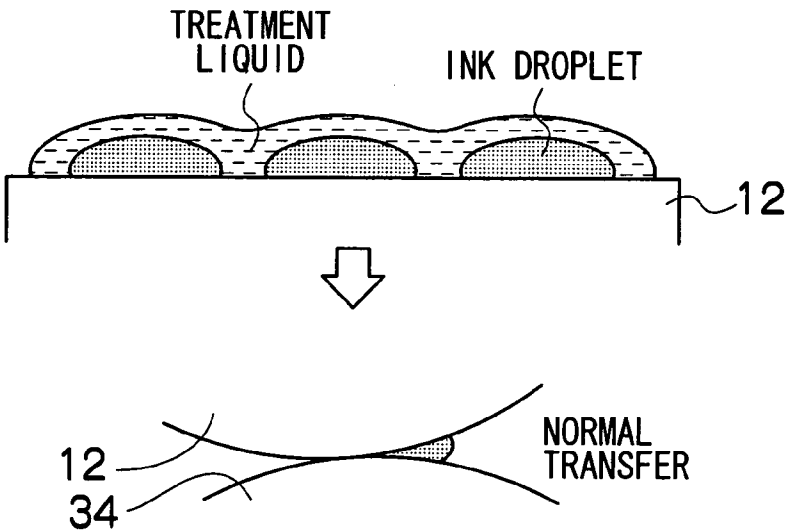

FIGS. 6A and 6B are diagrams showing the relationship between the deposition volume of treatment liquid and ink, and the transfer rate.

As shown in FIG. 6A, if the deposition volume of the treatment liquid per unit surface area is smaller than the deposition volume of the ink per unit surface area, then the ink droplets that have landed on the intermediate transfer body 12 do not become completely submerged in the treatment liquid layer formed previously on the intermediate transfer body 12, and unreacted portions where the ink does not react with the treatment liquid (including portions where there is insufficient reaction) occur. When transfer is carried out in a state where there are the unreacted portions of this kind, then as shown in FIG. 6A, the ink droplet (deposited ink dot) on the intermediate transfer body 12 is torn off (this kind of phenomenon is called "dot fracture"), and the image on the intermediate transfer body 12 is not transferred precisely onto the recording medium 34 and residual matter is left on the intermediate transfer body 12 after the transfer.

On the other hand, as shown in FIG. 6B, if the deposition volume of the treatment liquid per unit surface area is not smaller than the deposition volume of the ink per unit surface area, then the ink droplets that have landed on the intermediate transfer body 12 become submerged in the treatment liquid layer, and hence a reaction with the treatment liquid proceeds in the whole parts of the ink droplets, the ink droplets themselves display elastic properties during transfer from the intermediate transfer body 12 to the recording medium 34, and therefore the image on the intermediate transfer body 12 is transferred correctly to the recording medium 34 with no occurrence of dot fractures.

From the viewpoint of image quality, desirably, the spreading rate of the ink droplets is not less than 1.5 and not more than 4.0. The spreading rate is the ratio ($D_2/D_1$) of the diameter $D_2$ of an ink droplet (deposited ink dot) in a steady state after deposition with respect to the diameter $D_1$ of the ink droplet during flight.

Figure 7:
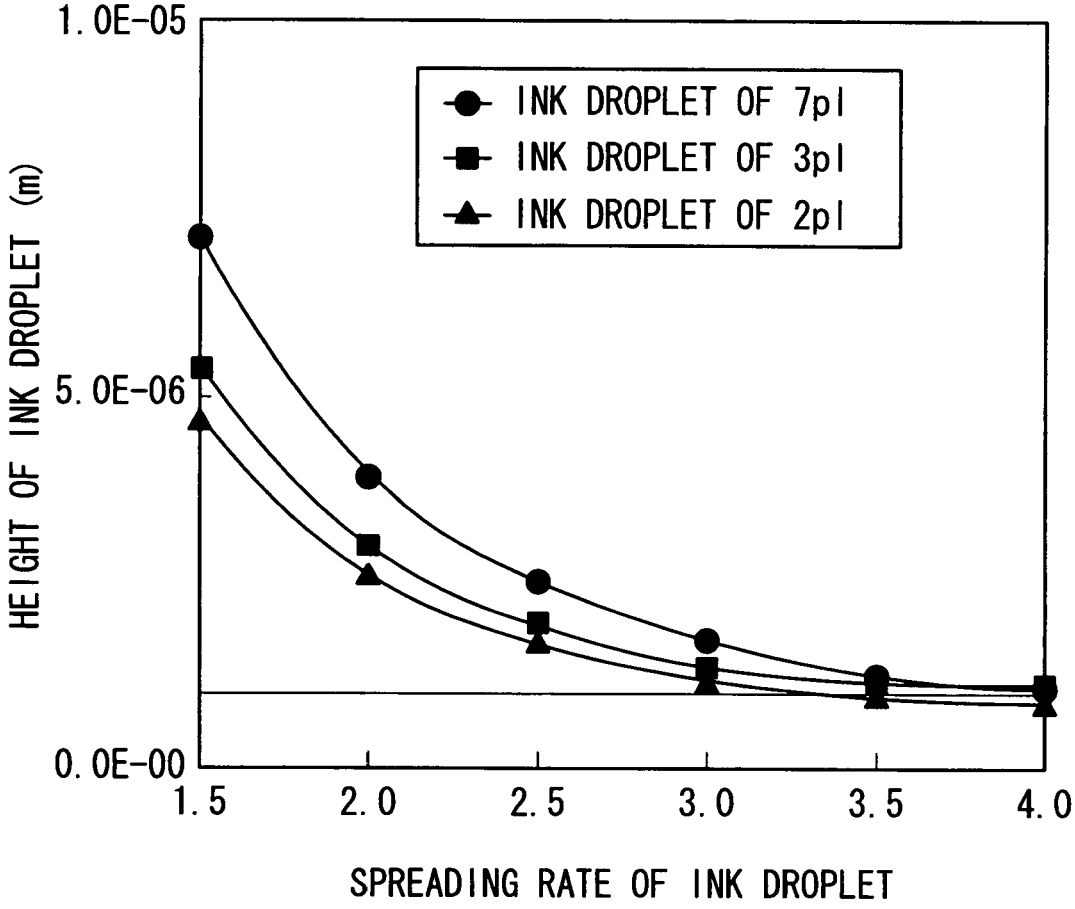
FIG. 7 is a graph showing the relationship between the spreading rate of the ink droplets and the height of the ink droplets.

FIG. 7 is a graph showing the relationship between the spreading rate of the ink droplets and the height of the ink droplets. In FIG. 7, for example, if the volume of the ink droplets is 2 pl, then the height (thickness) of an ink droplet that satisfies the desired spreading rate (not less than 1.5 and not more than 4.0) is 0.9 μm to 4.6 μm, based on actual measurement. Therefore, the minimum thickness of the treatment liquid layer formed on the intermediate transfer body 12 must be not smaller than 1 μm. The same applies if the volume of the ink droplet is other than this (3 pl, 7 pl), and therefore, regardless of the volume of the ink droplets, it is desirable that the minimum thickness of the treatment liquid layer should be 1 μm or above.

On the other hand, the greater the maximum thickness of the treatment liquid layer, the greater the liability of the aggregated coloring material to float in the treatment liquid without becoming attached to the intermediate transfer body 12, thus giving rise to image disturbance on the intermediate transfer body 12. Therefore, it is desirable that the maximum thickness of the treatment liquid layer formed on the intermediate transfer body 12 should be 9 μm or less.

From the foregoing, in order to prevent transfer defects, it is desirable that ejection should be controlled in order to satisfy the conditions that the minimum thickness of the treatment liquid layer formed on the intermediate transfer body 12 when an ink droplet lands on the intermediate transfer body 12 is not smaller than 1 μm, and that the treatment liquid deposition volume per unit surface area is not smaller than the ink deposition volume per unit surface area. By this means, a state is achieved in which the ink droplets are submerged in the treatment liquid on the intermediate transfer body 12, and reaction proceeds in the whole of the ink droplets, thereby causing the solvent-insoluble material (coloring material, or the like) contained in the ink to aggregate immediately. Consequently, as well as improving the image quality on the intermediate transfer body 12, it is also possible to achieve good transfer from the intermediate transfer body 12 to the recording medium 34, even when using the high-speed system. Therefore, no residual material is left on the intermediate transfer body 12 after the transfer and it is possible to reduce the cleaning load relating to the intermediate transfer body 12 after the transfer.

If a plurality of colored inks are used, the deposition volume of the treatment liquid per unit surface area should be not smaller than the deposition volume of the colored ink having the maximum deposition volume per unit surface area, of the respective colored inks. In the case of the present embodiment, four types of colored inks (K, C, M and Y) are used, and then the treatment liquid is deposited in such a manner that the following relationship is satisfied:

$$V_S \geqq V_K, V_C, V_M, V_Y,$$

where $V_S$ (g/m$^2$) is the deposition volume of the treatment liquid per unit surface area in the image region, and $V_K$ (g/m$^2$), $V_C$ (g/m$^2$), $V_M$ (g/m$^2$) and $V_Y$ (g/m$^2$) are the deposition volumes per unit surface area of the colored inks of black, cyan, magenta and yellow, respectively.

Next, the second ejection control condition is described. The second ejection control condition is the condition that the minimum thickness of the treatment liquid layer formed on the intermediate transfer body 12 when ink droplets land on the intermediate transfer body 12 should be 1 μm or above, and that the treatment liquid should be deposited not only on the image region where the ink droplets are deposited, but also on the peripheral region surrounding the image region.

In general, in order to improve the transfer rate, the intermediate transfer body 12 is often made of a material having liquid-repelling properties, and hence the droplet of the treatment liquid that has been deposited on the intermediate transfer body 12 has a state proximate to a spherical shape, the drying speed of this droplet is fast, and the drying time of the droplet of 2 pl is approximately 0.14 seconds at a temperature of 25° C. and humidity of 50%. In the present embodiment, the time interval from depositing the treatment liquid onto the intermediate transfer body 12 until depositing the ink droplets is approximately 0.1 seconds. In other words, since the drying time of the treatment liquid is approximately the same as the time interval from the deposition of the treatment liquid until the deposition of the ink, then it is necessary to take account of the drying of the treatment liquid on the intermediate transfer body 12. In the case of a method which deposits treatment liquid and ink directly onto a recording medium, the treatment liquid immediately permeates into the recording medium and hence drying of the treatment liquid is not liable to become a problem.

Due to these circumstances, desirably, the minimum thickness of the treatment liquid layer formed on the intermediate transfer body 12 when an ink droplet lands on the intermediate transfer body 12 should be not smaller than 1 μm, and furthermore, the treatment liquid should be deposited not only on the image region where the ink droplets are deposited but also on the peripheral region that surrounds this image region, in such a manner that the ink droplets are deposited in a state where a sufficient volume of the treatment liquid for reacting with the ink droplets is left on the intermediate transfer body 12, even if the treatment liquid deposited on the intermediate transfer body 12 dries and gives rise to a shrinking effect. The reason that the minimum thickness of the treatment liquid layer when the ink droplets are deposited should be 1 μm or above is the same as that of the first ejection control condition, and therefore further explanation thereof is omitted here.

Figure 8A:
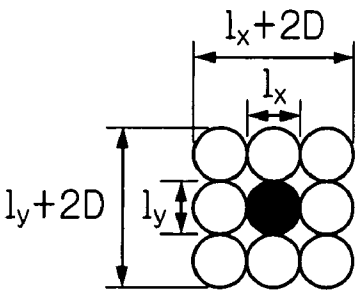
FIGS. 8A to 8C are diagrams showing examples of deposition of the treatment liquid according to a second ejection control condition.
Figure 8B:
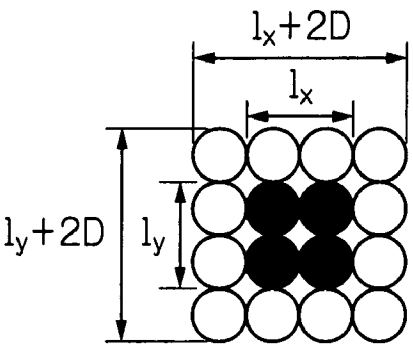
Figure 8C:
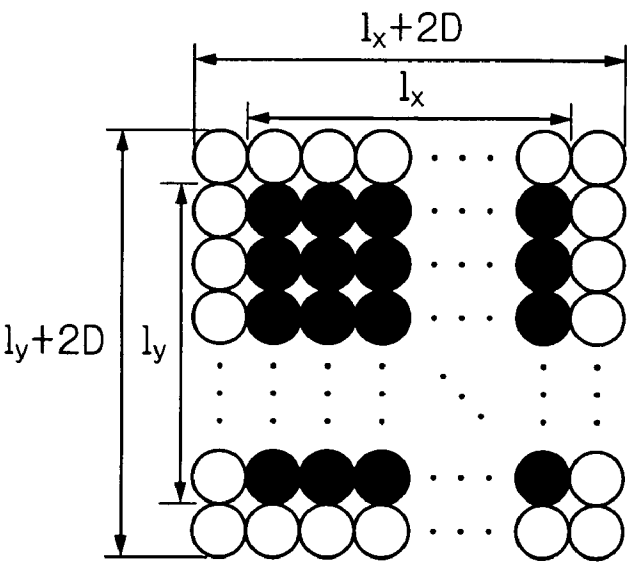

FIGS. 8A to 8C are diagrams showing examples of deposition of the treatment liquid according to the second ejection control condition. In FIG. 8A, a single solid circle shown on the inner side indicates a position to which both the droplet of the treatment liquid and the droplet of the ink are deposited, and blank circles surrounding the solid circle indicate positions to which only the droplets of the treatment liquid are deposited. In each of FIGS. 8B to 8C, a plurality of solid circles shown on the inner sides indicate positions to which both the droplets of the treatment liquid and the droplets of the ink are deposited, and blank circles surrounding the solid circles indicate positions to which only the droplets of the treatment liquid are deposited. Taking the length in the x direction of the image region where the ink droplet(s) is deposited as $l_x$, the length thereof in the y direction as $l_y$, and the diameter of the dot (the deposited ink dot) formed by the landed ink droplet as D, then as shown in FIGS. 8A to 8C, the treatment liquid is deposited over a region of $(l_x+2D)\times(l_y+2D)$ that includes the image region of $l_x\times l_y$.

In this way, in the second ejection control condition, rather than depositing the treatment liquid only onto the image region where the ink droplets are deposited, the treatment liquid is also deposited onto the peripheral region surrounding the image region, and desirably, onto the region that extends from every side of the image region by at least a length corresponding to the size of the deposited ink dot.

Consequently, even if the treatment liquid dries on the intermediate transfer body 12 and a shrinkage effect occurs, then the treatment liquid of a sufficient volume to react with the ink droplets is remain. Therefore, as well as improving the image quality on the intermediate transfer body 12, it is also possible to achieve good transfer from the intermediate transfer body 12 to the recording medium 34, even when using the high-speed system. As a result of this, no residual material is left on the intermediate transfer body 12 after the transfer and it is possible to reduce the cleaning load relating to the intermediate transfer body 12 after the transfer.

In the respective ejection control conditions described above, desirably, the surface tension of the treatment liquid should be not lower than the surface tension of the ink. Accordingly, since the treatment liquid has the function of improving the wetting properties of the ink, as well as the function of promoting the aggregating reaction of the ink, then the wetting properties of the ink are improved, the spreading rate not less than 1.5 and not more than 4.0 can be achieved for the ink droplets deposited on the intermediate transfer body 12, and hence the image quality on the intermediate transfer body 12 can be improved.

Moreover, in the respective ejection control conditions, from the viewpoint of image quality and ejection stability, it is desirable that the concentration of solvent-insoluble material contained in the ink should be in the range of 1 wt % to 20 wt %. If the concentration of the insoluble material is less than this range, then in terms of image quality, sufficient optical density is not obtained, whereas if the concentration is greater than this range, then the ejection stability declines due to increase in the viscosity of the ink.

Further, in the respective ejection control conditions, it is desirable that the treatment liquid should be deposited in such a manner that it forms a substantially uniform thickness on the intermediate transfer body 12. Moreover, it is desirable that the spreading rate of the treatment liquid on the intermediate transfer body 12 is not less than 2. Moreover, it is desirable that the angle of contact of the treatment liquid with respect to the intermediate transfer body 12 is not greater than 70 degrees. Moreover, it is desirable that the intermediate transfer body 12 is made of a material having low surface energy and high separating characteristics (for example, silicone rubber, fluorocarbon rubber, or the like). Moreover, it is desirable that the treatment liquid contains a surfactant.

Figure 9B:
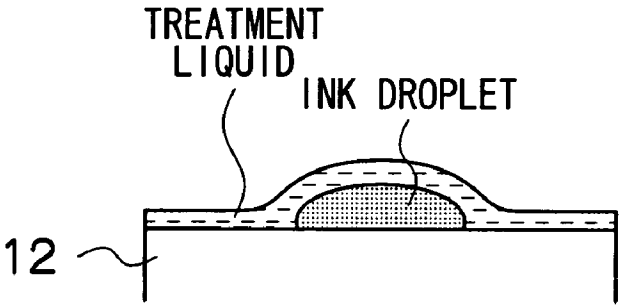
FIGS. 9A and 9B are diagrams for explaining aspects of wetting and spreading of the treatment liquid on the surface of an ink droplet.
Figure 9A:
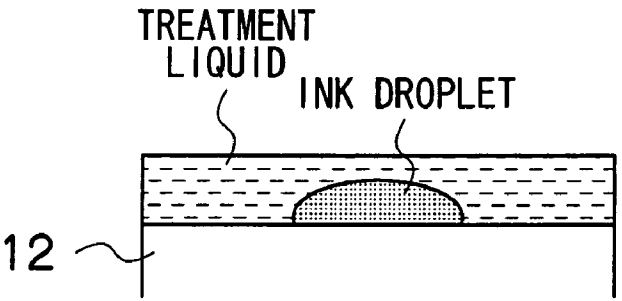

Furthermore, in the respective ejection control conditions, it is desirable that the treatment liquid should immediately spread and coat the surface of the ink droplet that has landed on the intermediate transfer body 12 (deposited ink dot), as shown in FIGS. 9A and 9B. By this means, it is possible to prevent landing interference between the deposited ink droplets of the same color or of different colors. In order to achieve this, it is desirable that the treatment liquid contains a surfactant of low molecular weight, for example. Moreover, it is desirable that the time from the deposition of the ink droplets on the intermediate transfer body 12 until the spreading and coating of the treatment liquid is not longer than 30 μs, and the spreading and coating speed is not less than 0.5 m/s.

The above-described embodiments relate to a mode where the treatment liquid is deposited onto the intermediate transfer body 12 by ejecting droplets of the treatment liquid from the treatment liquid head 30S, but in implementing the present invention, there are no particular restrictions on the method of depositing the treatment liquid.

In a modification of the present embodiment, there is also a mode where the treatment liquid is applied onto the intermediate transfer body 12 by using an application roller, instead of the treatment liquid head 30S. According to this, it is also possible to deposit the treatment liquid readily onto virtually the whole surface of the intermediate transfer body 12 including the image region where ink droplets are deposited. In this modification, it is desirable that the thickness of the treatment liquid layer formed on the intermediate transfer body 12 is not smaller than 1 μm and not greater than 5 μm. It is also possible to provide a device which regularizes the thickness of the treatment liquid layer on the intermediate transfer body 12. For example, there is a method which uses an air knife and a method in which a member having a sharp angle is provided at a specific gap corresponding to the thickness of the treatment liquid layer, from the intermediate transfer body 12.

The above-described embodiments relate to a mode where the first liquid is the ink containing the coloring material, but the implementation of the present invention is not limited to this. For example, there is also a mode where the first liquid is a liquid containing metal, and a wiring pattern is transferred and formed onto a recording medium.

EXAMPLES

The present invention is described in more specific terms below with reference to practical examples.

Ink

The ink having the following composition was used: pigment of 5 wt %; glycerine of 20 wt %; diethyelene glycol of 10 wt %; olefin of 1 wt %; latex of 5 wt %; and pure water of 59 wt %.

For the pigment, it is possible to use any one of: C.I. Pigment Yellow 12, 13, 17, 55, 74, 97, 120, 128, 151, 155 and 180, or C.I. Pigment Red 122, C.I. Pigment Violet 19, C.I. Pigment Red 57:1, 146, and C.I. Pigment Blue 15:3. Here, C.I. Pigment Red 122 was used as a sample.

For the latex, it is possible to use a styrene-isoprene latex, with the object of improving the fixing characteristics on the recording medium, the wear resistance, and the transfer rate, of the ink.

A material for improving fixing characteristics, wear resistance and transfer rate may be an acrylic, urethane, polyester, vinyl, or styrene material, or the like. In order to display sufficiently the functions of the material in improving fixing characteristics, wear resistance and transfer rate, it is necessary to add a polymer of relatively high molecular weight, at a high concentration (1 wt % to 20 wt %). However, if it is sought to add the aforementioned material by dissolving into the ink, then the ink acquires a high viscosity and the ejection characteristics decline. In order to add a suitable material at a high concentration into the ink while suppressing increase in the viscosity of the ink, a method in which adds the material in the form of a latex is added into the ink is valuable. Possible latex materials are, for instance: alkyl acrylate copolymer, carboxyl-modified SBR (styrene-butadiene latex), SIR (styrene-isoprene latex), MBR (methylmethacrylate-butadiene latex), NBR (acrylonitrile-butadiene latex), or the like.

The glass transition point Tg of the latex has a significant effect during the transfer process, and desirably, it is not lower than 50° C. and not higher than 120° C., when factors such as the stability at normal temperature and the transfer characteristics after heating are taken into account. Moreover, during the process, the minimum film forming temperature (MFT) also has a significant effect on fixing and desirably it is not higher than 100° C., and more desirably, not higher than 50° C.

The inks were manufactured by preparing a plurality of different types of the latex materials having good dispersibility, solid images were formed on art paper, and the printed art paper was subjected to a tape separation test, an abrasion test and transfer rate measurement. The results are shown in Table 1.

TABLE 1

| No. | Composition | Tg (° C.) | MFT (° C.) | Fixing characteristics (tape separation test) | Wear resistance | Transfer rate |
|---|---|---|---|---|---|---|
| 1 | SBR latex | 58 | >65 | Good | Good | Good transfer rate 80% |
| 2 | Self cross-linking acrylate latex | 43 | >45 | Poor | Poor | Poor transfer rate 60% or less |
| 3 | SIR latex | 45 | >65 | Poor | Poor | Good transfer rate 80% |
| 4 | Acrylic latex | 45 | 18-21 | Excellent | Excellent | Excellent transfer rate 95% |
| 5 | Styrene acrylic latex | 58 | >65 | Fair | Poor | Poor transfer rate 60% or less |

As shown in Table 1, a case using acrylic latex was satisfactory in respect of each of the items of: fixing characteristics, wear resistance and transfer rate. In the case of SBR, it is considered that satisfactory results can be obtained in respect of the fixing characteristics, wear resistance and transfer rate, because an SBR material is contained in the surface layer of the art paper.

In the present experiments, latex was added to the ink, but it has been confirmed that similar fixing characteristics can be obtained even if it is added to the treatment liquid, or if a latex dispersion alone is added by means of a separate head, prior to the transfer.

In temperature conditions of 25° C., the surface tension of the ink was set to a range of 10 mN/m to 50 mN/m, and the viscosity of the ink was set to a range of 1 mPa·s to 20 mPa·s. In the present experiments, the surface tension of the ink was 31.2 mN/m and the viscosity of the ink was 4.9 mPa·s.

Treatment Liquid

The liquid having the following composition was used as the treatment liquid: 15 fluorocarbon surfactant of 0.1 wt %; and pure water of 99.9 wt %.

The treatment liquid is a liquid of low pH, which has the function of causing the coloring material in the ink to aggregate when it is mixed with the ink. The angle of contact of the treatment liquid with the silicone rubber used for the intermediate transfer body 12 was 62 degrees, and therefore wetting properties are relatively high.

In temperature conditions of 25° C., the surface tension of the treatment liquid was set to a range of 10 mN/m to 50 mN/m, and the viscosity of the treatment liquid was set to 1 mPa·s to 20 mPa·s. In the present experiments, the surface tension of the treatment liquid was 28.0 mN/m, and the viscosity of the treatment liquid was 3.1 mPa·s.

Image Forming Apparatus

The image forming apparatus used had the composition of the inkjet recording apparatus 10 shown in FIG. 1, namely, a basic composition including the transfer body 12, the treatment liquid supply unit 14, the marking unit 16, and the transfer unit 18, with the addition of the solvent removal unit 20. The specific composition of the apparatus and conditions are described below.

A 0.5 mm-thick silicone rubber sheet SR series (manufactured by Tigers Polymer Corp.) was used as the intermediate transfer body 12.

A minimum composition including one recording head each in the treatment liquid supply unit 14 and the marking unit 16 was adopted, and piezoelectric type of heads, the PX-G920 (manufactured by Epson Corp.), were used as the recording heads. It would have been possible to use a recording head (the treatment liquid head) in the treatment liquid supply unit 14 of a lower resolution than the recording head (the ink head) in the marking unit 16, but in the present experiments, the heads of the same characteristics were used.

A metallic porous member (a member formed by sintering titanium oxide particles) was used as the solvent removal roller 26.

The transfer pressure in the transfer unit 18 was set to 10 kPa, and the heating temperature of the rollers 36 and 26B in the transfer unit 18 was set to 80° C.

The conveyance speed (rotational speed) of the intermediate transfer body 12, and the conveyance speed of the recording medium 34 were both set to 0.5 m/s (which corresponds to 120 ppm).

Art paper (Tokubishi art, manufactured by Mitsubishi Paper Mills Ltd.) was used as the recording medium 34.

Assessment 1

Using the treatment liquid, the ink and the image forming apparatus described above, the transfer experiment described below was carried out, by setting the liquid volume per droplet of the treatment liquid to 14 pl, the liquid volume per droplet of the ink to 7 pl, and the spreading rate of the ink droplets to 3.5 to 4.0. In implementing the present invention, there are no particular restrictions on the liquid volumes per droplet ejected from the respective recording heads 30, and the liquid volume per droplet of the treatment liquid may be greater than, the same as, or smaller than, the liquid volume per droplet of the ink.

In the present transfer experiments, substantially circular dots of deposited ink were formed on the intermediate transfer body 12, while varying the minimum thickness of the treatment liquid layer formed on the intermediate transfer body 12 and the ratio between the ink deposition volume per unit surface area and the treatment liquid deposition volume per unit surface area, respectively, within appropriate ranges, and the number of dots transferred completely without any errors was counted with respect to arbitrary 25 (=5×5) deposited ink dots on the intermediate transfer body 12. In this case, taking the transfer rate to be the ratio of completely transferred dots, the transfer was evaluated and judged as follows: a transfer rate of less than 90% as "poor", a transfer rate not less than 90% and less than 95% as "good", and a transfer rate not less than 95% as "excellent". The results are shown in Table 2.

TABLE 2

| No. | Thickness of treatment liquid layer (μm) | Treatment liquid deposition volume/ Ink deposition volume | Transfer rate | Judgment |
|---|---|---|---|---|
| 1 | 0.6 | 0.6 | 40% | Poor |
| 2 | 0.6 | 0.8 | 60% | Poor |
| 3 | 0.6 | 1.0 | 76% | Poor |
| 4 | 0.6 | 1.2 | 84% | Poor |
| 5 | 0.6 | 1.4 | 80% | Poor |
| 6 | 0.8 | 0.6 | 60% | Poor |
| 7 | 0.8 | 0.8 | 56% | Poor |

TABLE 2-continued

| No. | Thickness of treatment liquid layer (μm) | Treatment liquid deposition volume/ Ink deposition volume | Transfer rate | Judgment |
|---|---|---|---|---|
| 8 | 0.8 | 1.0 | 60% | Poor |
| 9 | 0.8 | 1.2 | 76% | Poor |
| 10 | 0.8 | 1.4 | 84% | Poor |
| 11 | 1.0 | 0.6 | 60% | Poor |
| 12 | 1.0 | 0.8 | 72% | Poor |
| 13 | 1.0 | 1.0 | 92% | Good |
| 14 | 1.0 | 1.2 | 96% | Excellent |
| 15 | 1.0 | 1.4 | 96% | Excellent |
| 16 | 1.2 | 0.6 | 52% | Poor |
| 17 | 1.2 | 0.8 | 80% | Poor |
| 18 | 1.2 | 1.0 | 92% | Good |
| 19 | 1.2 | 1.2 | 92% | Good |
| 20 | 1.2 | 1.4 | 96% | Excellent |
| 21 | 1.4 | 0.6 | 60% | Poor |
| 22 | 1.4 | 0.8 | 84% | Poor |
| 23 | 1.4 | 1.0 | 92% | Excellent |
| 24 | 1.4 | 1.2 | 100% | Excellent |
| 25 | 1.4 | 1.4 | 100% | Excellent |

As Table 2 shows, a transfer rate not less than 90% could be obtained in cases where the minimum thickness of the treatment liquid layer is not smaller than 1 μm, and where the ratio of the treatment liquid deposition volume per unit surface area with respect to the ink deposition volume per unit surface area is not less than 1. On the other hand, it was confirmed that if the aforementioned conditions are not satisfied, then the transfer rate becomes less than 90% and transfer defects are liable to occur.

Assessment 2

The following transfer experiments were carried out by setting the liquid volume per droplet of the treatment liquid to 7 pl and the liquid volume per droplet of the ink to 7 pl, in such a manner that the minimum thickness of the treatment liquid layer was 3 μm.

In the present transfer experiments, 25 images each having a single deposited ink dot as shown in FIG. 8A were formed, while varying the deposition region of the treatment liquid, and the number of successfully transferred images was counted. In this case, taking the transfer rate to be the ratio of completely transferred images, the transfer was evaluated and judged as follows: a transfer rate of less than 90% as "poor", a transfer rate not less than 90% and less than 95% as "good", and a transfer rate not less than 95% as "excellent". The results are shown in Table 3.

TABLE 3

| Treatment liquid deposition region in x direction (m) | Treatment liquid deposition region in y direction (m) | Transfer rate | Judgment |
|---|---|---|---|
| $l_x + D$ | $l_y + D$ | 72% | Poor |
| $l_x + D$ | $l_y + 2D$ | 80% | Poor |
| $l_x + D$ | $l_y + 3D$ | 84% | Poor |
| $l_x + 2D$ | $l_y + D$ | 84% | Poor |
| $l_x + 2D$ | $l_y + 2D$ | 92% | Good |
| $l_x + 2D$ | $l_y + 3D$ | 96% | Excellent |
| $l_x + 3D$ | $l_y + D$ | 80% | Poor |
| $l_x + 3D$ | $l_y + 2D$ | 92% | Good |
| $l_x + 3D$ | $l_y + 3D$ | 100% | Excellent |
| $l_x + 5D$ | $l_y + 5D$ | 100% | Excellent |
| $l_x + 10D$ | $l_y + 10D$ | 100% | Excellent |
| $l_x + 100D$ | $l_y + 100D$ | 100% | Excellent |

As Table 3 shows, if the treatment liquid is deposited onto a region that extends from every side of the image region by at least a length corresponding to the size of the deposited ink dot, then a successful transfer rate of 90% or above is obtained. Furthermore, it was also confirmed that good results, with a successful transfer rate of 100%, can be achieved in a broad region of $(l_x+3D)\times(l_y+3D)$ or greater. Here, from the viewpoint of reducing the amount of the treatment liquid, it is desirable that the deposition region of the treatment liquid is a region of $(l_x+3D)\times(l_y+3D)$ or less.

On the other hand, it was confirmed that if the treatment liquid is deposited onto a region that extends from every side of the image region by less than one dot, then the successful transfer rate is less than 90% and transfer defects are liable to occur.

Assessment 3

The following transfer experiments were carried out by setting the liquid volume per droplet of the treatment liquid to 7 pl and the liquid volume per droplet of the ink to 7 pl.

Figure 10:
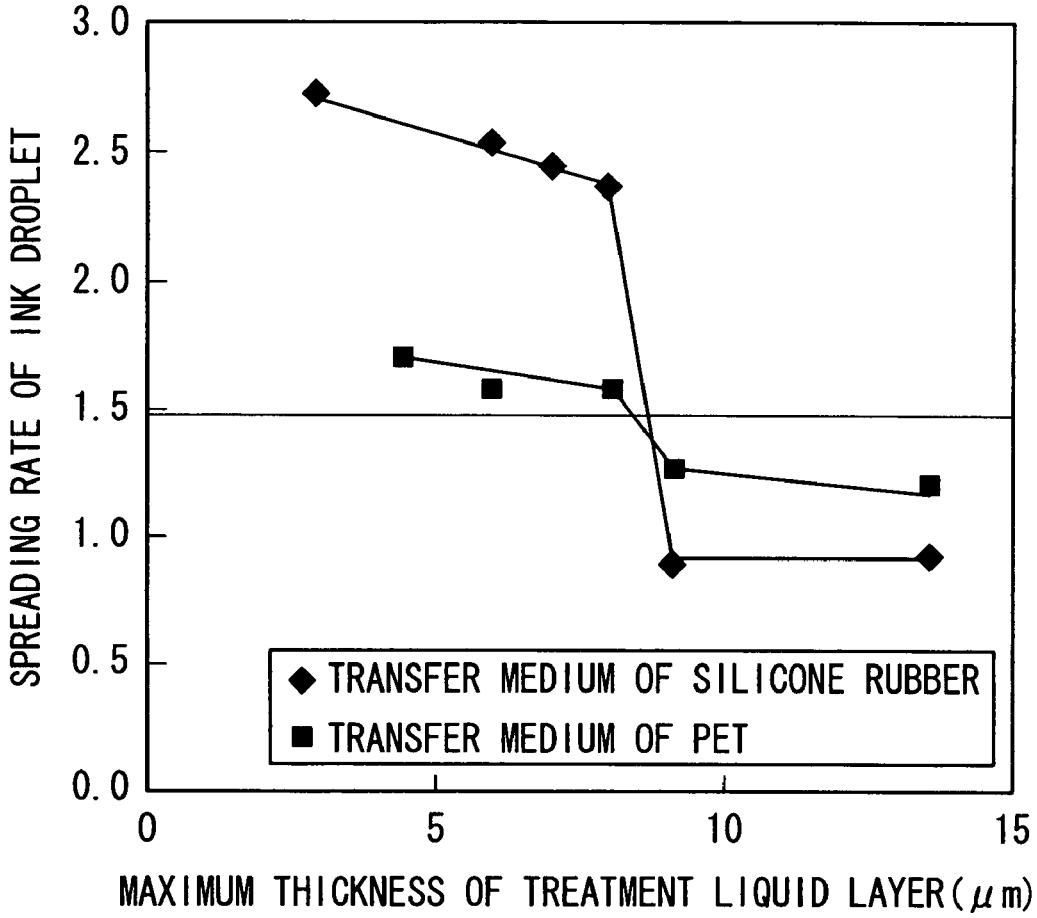
FIG. 10 is a graph showing the relationship between the maximum thickness of the treatment liquid layer and the spread rate of the ink droplet.

In the present transfer experiments, the spreading rate of the ink droplets in the case of variation in the maximum thickness of the treatment liquid layer was measured. In this case, the measurements were made using silicone rubber (with which the treatment liquid had a contact angle of 27°) and polyethylene terephthalate (PET) (with which the treatment liquid had a contact angle of 7°), as the material of the intermediate transfer body 12. The results are shown in FIG. 10.

As stated previously, from the viewpoint of image quality, it is preferable that the spreading rate of the ink droplets is not less than 1.5 and not greater than 4.0. In both the cases where silicone rubber (with which the treatment liquid had a contact angle of 27°) and PET (with which the treatment liquid had a contact angle of 7°) were used as the materials of the intermediate transfer body 12, it was confirmed that a desirable spreading rate of the ink droplets could be achieved by setting the maximum thickness of the treatment liquid layer to be not greater than 9 μm.

On the other hand, it was also confirmed that if the maximum thickness of the treatment liquid layer was greater than 9 μm, then the spreading rate of the ink droplets declines sharply. It is thought that the reason for this is the effect of the force of resistance acting on the ink droplets from the treatment liquid. More specifically, if the maximum thickness of the treatment liquid layer is large, then the ink droplets either do not impact against the intermediate transfer body 12, or they only impact against the intermediate transfer body 12 at a slow speed, then the ink droplets form aggregate inside the treatment liquid without spreading sufficiently over the intermediate transfer body 12, and hence the decline in the spreading rate of the ink droplets is observed.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus which forms an image on a recording medium by transferring an image formed on an intermediate transfer body to the recording medium, the apparatus comprising:

a first liquid deposition device which performs deposition of a first liquid onto the intermediate transfer body, the first liquid containing solvent-insoluble material;

a second liquid deposition device which performs deposition of a second liquid onto the intermediate transfer body before the deposition of the first liquid, the second liquid having a function of causing the solvent-insoluble material to aggregate; and a deposition control device which controls the deposition in such a manner that a minimum thickness of a layer of the second liquid formed on the intermediate transfer body at the deposition of the first liquid is not smaller than 1 μm, and a volume of the deposition of the second liquid per unit surface area is not smaller than a volume of the deposition of the first liquid per unit surface area, wherein a surface tension of the second liquid is not higher than a surface tension of the first liquid.

2. The image forming apparatus as defined in claim 1, wherein the maximum thickness of the layer of the second liquid is not greater than 9 μm.

3. The image forming apparatus as defined in claim 1, wherein the solvent-insoluble material includes a coloring material.

4. An image forming apparatus which forms an image on a recording medium by transferring an image formed on an intermediate transfer body to the recording medium, the apparatus comprising:

a first liquid deposition device which performs deposition of a first liquid onto the intermediate transfer body, the first liquid containing solvent-insoluble material;

a second liquid deposition device which performs deposition of a second liquid onto the intermediate transfer body before the deposition of the first liquid, the second liquid having a function of causing the solvent-insoluble material to aggregate; and a deposition control device which controls the deposition in such a manner that a minimum thickness of a layer of the second liquid formed on the intermediate transfer body at the deposition of the first liquid is not smaller than 1 μm, and the second liquid is deposited not only onto a first liquid deposition region onto which the first liquid is to be deposited, but also onto a peripheral region surrounding the first liquid deposition region, wherein a surface tension of the second liquid is not higher than a surface tension of the first liquid.

5. The image forming apparatus as defined in claim 4, wherein the peripheral region extends from every side of the first liquid deposition region by at least a length corresponding to a diameter of a dot formed by the first liquid.

6. The image forming apparatus as defined in claim 4, wherein the maximum thickness of the layer of the second liquid is not greater than 9 μm.

7. The image forming apparatus as defined in claim 4, wherein the solvent-insoluble material includes a coloring material.

8. An image forming method for forming an image on a recording medium by transferring an image formed on an intermediate transfer body to the recording medium, the method comprising the steps of:

depositing a first liquid onto the intermediate transfer body, the first liquid containing solvent-insoluble material; and depositing a second liquid onto the intermediate transfer body before the depositing step of the first liquid, the second liquid having a function of causing the solvent-insoluble material to aggregate, wherein a minimum thickness of a layer of the second liquid formed on the intermediate transfer body at the depositing step of the first liquid is not smaller than 1 μm, a volume of the deposited second liquid per unit surface area is not smaller than a volume of the deposited first liquid per unit surface area, and a surface tension of the second liquid is not higher than a surface tension of the first liquid.

9. An image forming method for forming an image on a recording medium by transferring an image formed on an intermediate transfer body to the recording medium, the method comprising the steps of:

depositing a first liquid onto the intermediate transfer body, the first liquid containing solvent-insoluble material; and before the depositing step of the first liquid, depositing a second liquid not only onto a first liquid deposition region onto which the first liquid is to be deposited on the intermediate transfer body, but also onto a peripheral region surrounding the first liquid deposition region, the second liquid having a function of causing the solvent-insoluble material to aggregate, wherein a minimum thickness of a layer of the second liquid formed on the intermediate transfer body at the depositing step of the first liquid is not smaller than 1 μm, and a surface tension of the second liquid is not higher than a surface tension of the first liquid.

* * * * *